United States Patent [19]

Hodsdon et al.

[11] 3,989,909

[45] Nov. 2, 1976

[54] GRILL FOR AUDIO LOUDSPEAKERS AND THE LIKE

[75] Inventors: Roy F. Hodsdon; Friedrich H. Mann; Henry A. Schaefer, all of Lynchburg, Va.

[73] Assignee: General Electric Company, Lynchburg, Va.

[22] Filed: Sept. 15, 1975

[21] Appl. No.: 613,624

[52] U.S. Cl. ..... 179/184; 181/175

[51] Int. Cl.[2] ..... H04R 1/02

[58] Field of Search ..... 179/1 E, 146 R, 178, 179/179, 184; 325/352, 361; 181/148–156, 175, 176, 194, 195

[56] References Cited

UNITED STATES PATENTS

| | | | |
|---|---|---|---|
| 2,580,916 | 1/1952 | Hodge | 181/144 |
| 2,701,617 | 2/1955 | Kock | 179/180 |
| 3,679,023 | 7/1972 | Rankin | 181/155 |
| 3,909,530 | 9/1975 | Gosswiller | 179/1 E |

*Primary Examiner*—George G. Stellar

*Attorney, Agent, or Firm*—James J. Williams

[57] ABSTRACT

A grill for a loudspeaker has a relatively thick metallic plate with a loudspeaker opening and a plurality of T-shaped bars across the opening, and a relatively thin metallic plate with a loudspeaker opening and a plurality of U-shaped bars across the opening. The plates are mounted together so that the U-shaped bars are located between but spaced from the T-shaped bars to provide physical protection to and good acoustic qualities for the loudspeaker. The relatively thick metallic plate provides a good heat sink for electronic equipment.

10 Claims, 7 Drawing Figures

GRILL FOR AUDIO LOUDSPEAKERS AND THE LIKE

BACKGROUND OF THE INVENTION

Our invention relates to an improved grill for audio loudspeakers and the like, and particularly to an improved grill that can be made of metal to provide good protection for the loudspeaker, to provide good acoustic qualities for the loudspeaker, and to provide a good heat sink for electronic equipment.

Many radio and electronic products are housed in cabinets or containers made of molded plastic. Molded plastic is used because it can have intricate shapes, is relatively strong, and is capable of being mass produced. For these and other reasons, radio and electronic equipment having or using a loudspeaker has been housed in a cabinet having a molded plastic grill. Such molded plastic grills provide good protection for the loudspeakers in that they prevent objects from being pushed into the relatively fragile cone or diaphram of the loudspeaker. Such grills also have good acoustic properties because they can be constructed in accordance with good acoustic designs.

In some applications, however, molded plastic is not satisfactory because of its poor heat transfer properties. For example, radio transceiver equipment having relatively high power electronic circuits produce a relatively large quantity of heat that cannot be removed by the plastic. Hence, the heat must be removed through a metallic heat sink arrangement that insures that the radio transceiver operates within the proper temperature limits. A metallic loudspeaker grill can form part of such a heat sink and provide good heat conduction and radiation properties because of its surface configuration and air flow properties, if the heat generating parts or components are mounted on or in metallic connection with the grill. However, the grill should protect the loudspeaker and have good acoustic qualities.

Accordingly, a primary object of our invention is to provide a new and improved metallic loudspeaker grill.

Another object of our invention is to provide a new and improved metallic loudspeaker grill that has good acoustic and protective qualities.

Another object of our invention is to provide a new and improved metallic loudspeaker grill that removes heat, that is relatively simple, and that can be mass produced.

Another and relatively specific object of our invention is to provide a new and improved metallic grill that has good heat removal properties, that has good acoustic qualities, and that provides good protection for the loudspeaker.

SUMMARY OF THE INVENTION

Briefly, these and other objects are achieved in accordance with our invention by a grill formed of two metallic plates. The first metallic plate, which serves as the main heat sink, is relatively thick and has a first opening through its thickness dimension. A plurality of flat metallic bars extend across this first opening. These bars are substantially parallel and have a reinforcing web. The second metallic plate, which serves to protect the loudspeaker against the first opening, is relatively thin and has a second opening through its thickness dimension. A plurality of flat metallic strips extend across this second opening. These strips are substantially parallel and have centers spaced substantially the same as the metallic bars on the first plate. Each of the metallic strips has a metallic reinforcing member extending along each of its two longer edges, these reinforcing members extending in the same direction. The two plates are assembled together with the center of each of the strips of the relatively thin plate positioned symmetrically between an adjacent pair of the reinforcing webs and spaced from the bars and their reinforcing webs. When assembled, the plates provide a protective grill that has good acoustic qualities. And, the first plate acts as a good heat sink for electronic equipment.

BRIEF DESCRIPTION OF THE DRAWING

The subject matter which we regard as our invention is particularly pointed out and distinctly claimed in the claims. The structure and operation of our invention, together with further objects and advantages, may be better understood from the following description given in connection with the accompaning drawing, in which:

DESCRIPTION OF A PREFERRED EMBODIMENT

Figure 1:
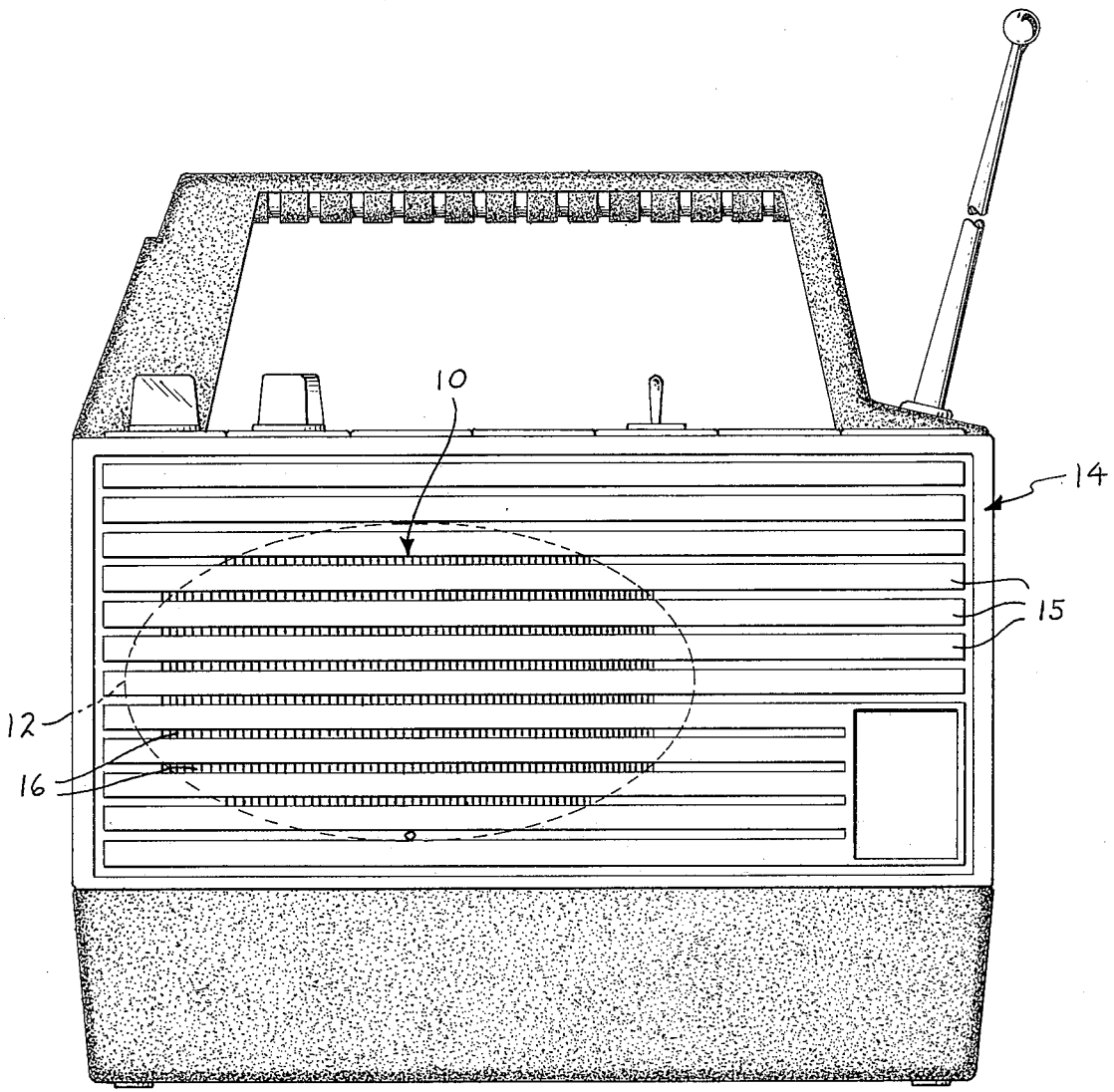
FIG. 1 shows an elevation view of a portable, two-way radio having a grill in accordance with our invention.

In FIG. 1, we have shown one example of where a loudspeaker grill in accordance with our invention can be used. FIG. 1 illustrates a portable, two-way radio which, while relatively compact, produces a relatively large amount of radio frequency power. Such power is, today, almost always produced by solid state devices such as transistors. These transistors carry considerable current which produces considerable heat. As persons skilled in the art will appreciate, such heat must be dissipated or removed in order that the transistors operate properly and in order that the radio not be damaged or destroyed. Accordingly, in the radio shown in FIG. 1, as well as in other applications, a considerable demand exists for some means by which this heat can be removed. A radio such as shown in FIG. 1 is typically made of molded plastic which lends itself well to such radios because it is relatively strong and can be molded in intricate forms and shapes, and because such shapes permit the loudspeaker behind the grill to be adequately protected and yet have a good acoustic path to the outside. However, the typical plastic used in such construction does not conduct heat well, or at least certainly not as well as typical or generally available metals. Accordingly, there is a need for a metallic grill to remove heat from the inside of an electronic device such as the radio of FIG. 1, and at the same time provide good protection and a good acoustic path for the loudspeaker behind the grill.

Figure 3:
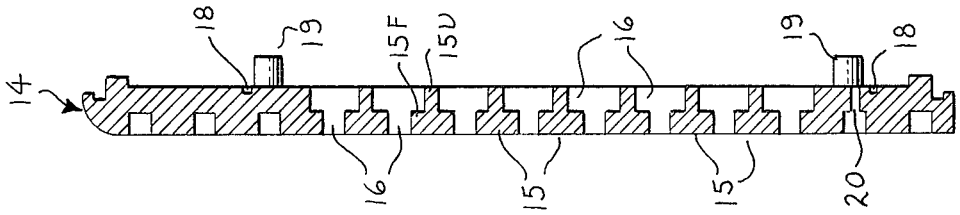
FIG. 3 is a cross-sectional view of the first plate of our grill taken along the lines 3—3 in FIG. 2.
Figure 2:
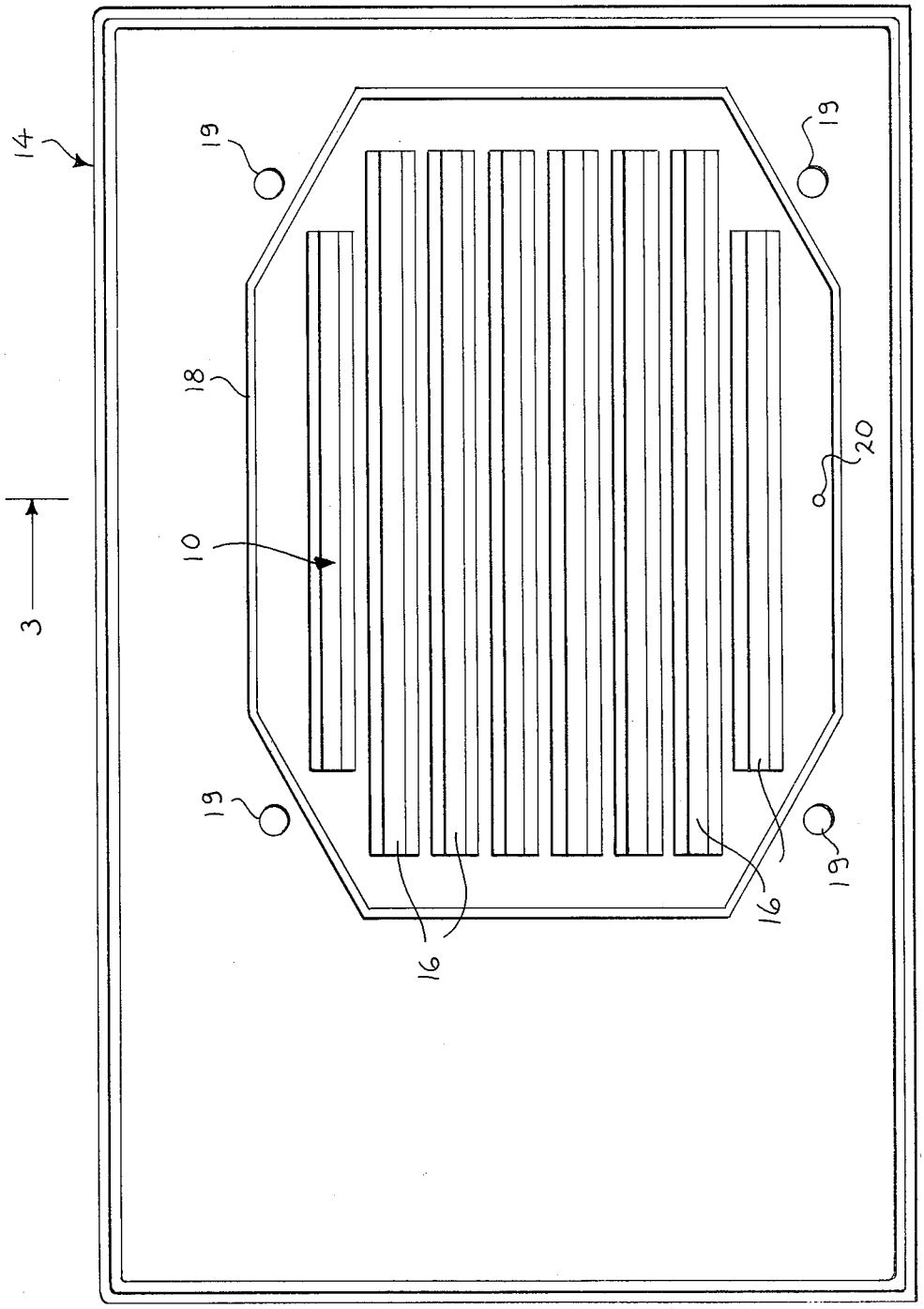
FIG. 2 shows a plan view of the first metallic plate forming part of our grill.

In FIG. 1, our grill, generally designated by the reference numeral 10, provides an acoustic opening in the area of a loudspeaker (behind the grill 10) indicated by the dashed line 12. Our grill 10 is formed of two plates, the first of which is a relatively thick, metallic plate 14 located on the outside and visible in FIG. 1. The second plate 25 is a relatively thin, metallic plate which is located on the inside and is not visible in FIG. 1. The first plate 14 is shown in FIG. 1 from the outside, is shown in FIG. 2 from the inside, and is further shown in FIG. 3 which is a cross-sectional view taken along the lines 3—3 in FIG. 2. With particular reference to FIGS. 2 and 3, our first plate 14 is preferably integral and formed of a piece of nonmagnetic cast metal such as aluminum. In one embodiment actually constructed, this plate 14 was approximately 0.22 inch thick. The outer face of the first plate 14 has a plurality of bars 15 extending along its entire length to provide more surface area which, in turn, provides better heat radiation. In the area of the grill 10 in the plate 14, openings 16 (a total of eight in this embodiment) are provided through the thickness of the plate 14 between the bars 15. As will be seen in FIG. 2, this provides a grill opening that substantially conforms to the shape of the loudspeaker, but that has a plurality of equally spaced bars 15 extending in substantially parallel directions across the opening. In the area of the grill opening, each of the bars 15 is formed of a flat portion 15F and a perpendicular or upright reinforcing portion 15U positioned centrally along the flat portion 15F as shown in the cross-sectional view of FIG. 3. Thus, the bars 15 in the vicinity of the grill opening may be termed or designated T-shaped, with the flat portion or top 15F of the T positioned to face toward the outside, and with the upright portion or bottom 15U of the T positioned to face toward the inside. As shown in FIGS. 2 and 3, the T-shaped bars 15 have substantially identical T-shaped cross-sections, and are substantially equally spaced along parallel lines over their longitudinal length. A relatively shallow, sealing groove 18 is placed around the general configuration of the opening to provide space for sealing material to provide a moisture or dampness barrier. Four bosses or projections 19 are positioned around this groove 18 to properly locate the second plate 25, and also a loudspeaker. A small drain hole 20 is also provided.

Figure 5:
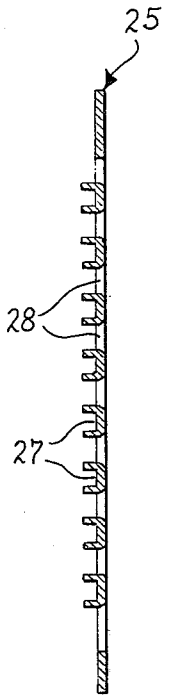
FIG. 5 is a cross-sectional view of the second plate of our grill taken along the lines 5—5 in FIG. 4.
Figure 4:
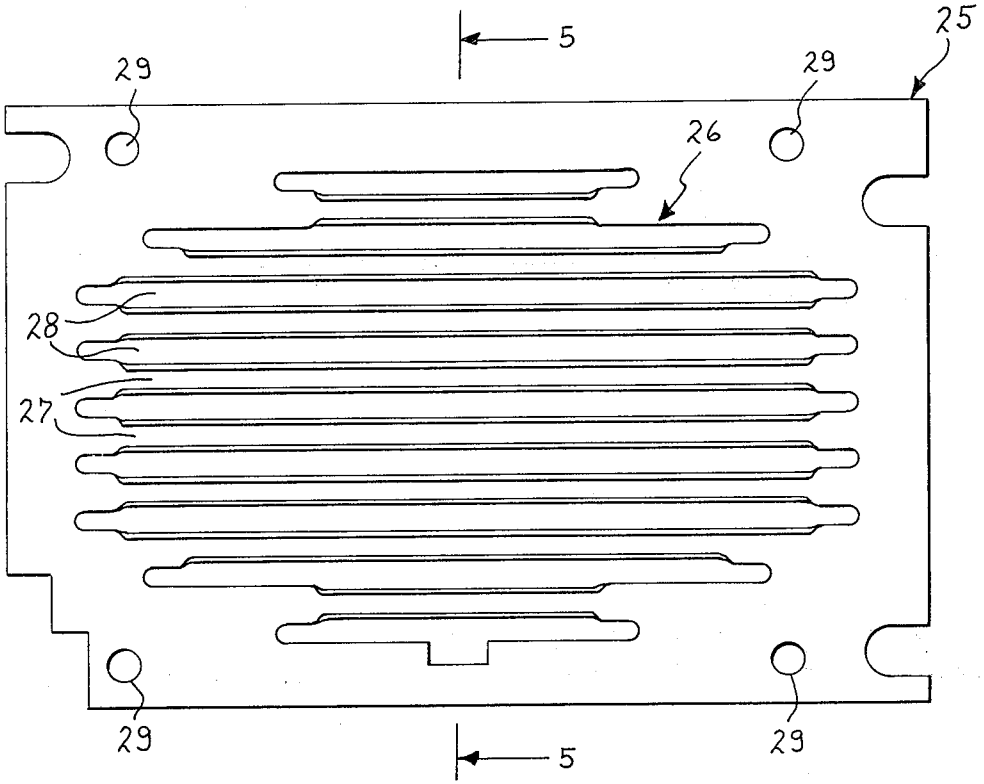
FIG. 4 shows a plan view of the second metallic plate forming part of our grill.

If the loudspeaker were not subject to physical damage, the grill 10 provided by the first plate 14 would be ideal, inasmuch as it would provide a metallic structure which is a good heat sink. However, the spaces or openings 16 between the bars 15 will permit small, thin, elongated objects to pass and damage the relatively fragile cone or diaphram of the loudspeaker. Hence, an additional structure is needed in order to close these spaces to physical objects. This physical structure is provided by our second plate 25 which is shown in FIGS. 4 and 5, and which is preferably formed from a sheet of nonmagnetic metal. In the constructed embodiment mentioned in connection with FIGS. 2 and 3, the second plate 25 was formed from a single sheet of aluminum approximately 0.02 inch thick that could be relatively easily punched or stamped to provide the desired configuration.

The second plate 25 is provided with an opening 26 which also generally conforms to the grill 10 and the shape 12 of the loudspeaker indicated by the dashed line in FIG. 1. A plurality of U-shaped bars 27 extend across this opening 26 in substantially parallel directions, and with their centers substantially equally spaced. The opening 26 and the U-shaped bars 27 may be and preferably are formed by first cutting a plurality of slits across the area where the opening 26 is to be located. The edges of the metal strips are then bent upward in the same direction to form the reinforced U-shaped configuration or cross-section shown in FIG. 5. When the bars 27 are so formed, they are substantially similar and have substantially parallel edges. This leaves a plurality of substantially similar openings 28 between the bars 27. Four locating holes 29 are provided in the plate 25 to receive the projections 19 on the first plate 14, and thereby accurately position locate the two plates together.

Figure 6:
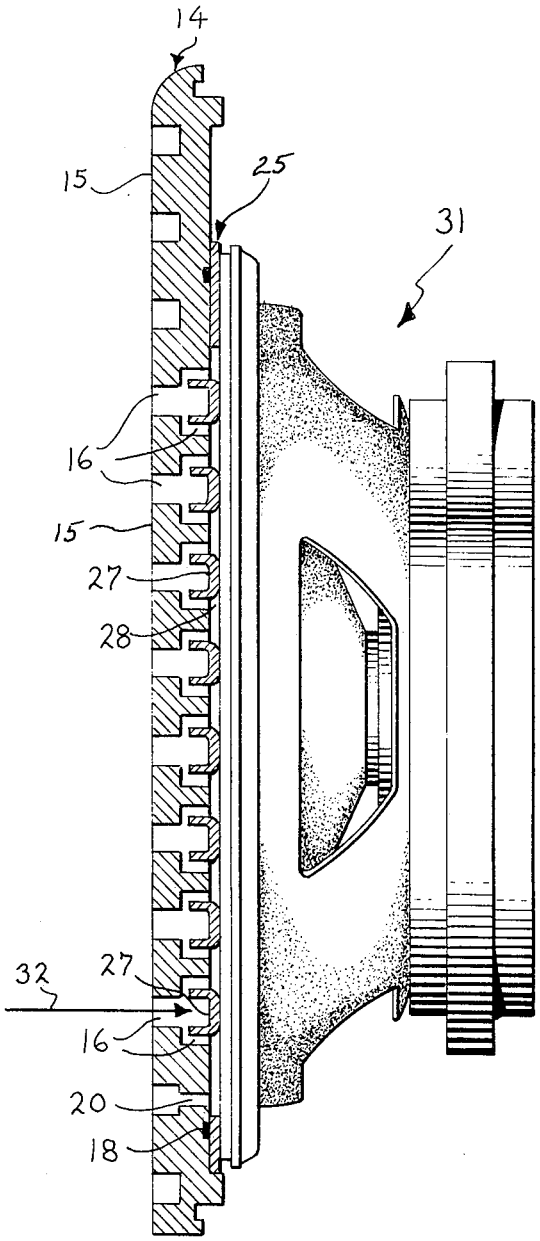
FIG. 6 shows a cross-sectional view of the two plates of our grill mounted together, with a loudspeaker in its proper position behind our grill.
Figure 7:
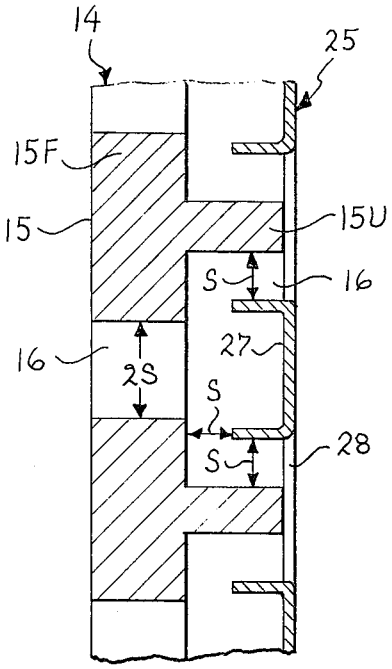
FIG. 7 shows an enlargement of a part of FIG. 6.

FIG. 6 shows a cross-sectional view of our grill 10 when the two plates 14, 25 are assembled or joined with a loudspeaker 31. The plates 14, 25 provide good acoustic properties and protection for the loudspeaker 31. And, at least the plate 14 provides a good heat sink for electronic equipment. During the assembly, the second plate 25 is positioned on the first plate 14, using the locating holes 29 and the projections 19. The loudspeaker 31 is positioned on the second plate 25, using locating holes in the loudspeaker rim and the projections 19. The three parts may be held together by any suitable means (not shown). After assembly, the open parts of the U-shaped bars 27 face outward from the loudspeaker 31, and the base or upright portions 15U of the T-shaped bars 15 face inward toward the loudspeaker 31. In the grill area, the U-shaped bars 27 of the second plate 25 are symmetrically positioned between adjacent pairs of upright portions 15U of the T-shaped bars 15, and are equally spaced from these bars 15. This equal spacing is shown in FIG. 7 by the dimension S, where the outer surface of each upright portion forming the U-shape is spaced the same distance S from the surface forming the top 15F of the T-shape, and is spaced the same distance S from the surface forming the base 15U of the T-shape. This spacing S is half the spacing 2S between adjacent flat portions 15F of the bars 15 so that the acoustic volume in two spacings S is merged into the acoustic volume in the one spacing 2S. We have found that this spacing relationship provides good acoustic qualities, namely permitting the sound to come from the loudspeaker through these spacings with no distortion and with no vibration of the relatively thin second plate 25. The U-shaped bars 27 and the T-shaped bars 15 are relatively rigid, and with the U-shaped bars 27 located in the openings 16 between the T-shaped bars 15, this rigidity and configuration prevent any objects from being inserted through our grill, as shown by the arrow 32, thus preventing damage to the cone and other parts of the loudspeaker 31.

The sealing groove 18 shown in FIG. 2 may be, and preferably is, filled with a sealant such as RTV Silicone Rubber, just before the second plate 25 is placed on the first plate 14 during assembly. This provides a tight seal in the area of the grill 10, and prevents any dampness or water from getting into the radio. In addition, the drain hole 20 at the bottom of the grill 10 removes any moisture which may get through the openings and into the cone or diaphram volume of the loudspeaker 31.

It will thus be seen that our grill provides an improved construction which may be formed of metal and thus provide a good heat sink for electronic equipment. If desired, the heat producing objects in the electronic equipment may be mounted directly on the first plate 14, or may be metallically connected to the first plate 14. In either case, heat can be removed by conduction and then by radiation through the numerous bars of the first plate 14. In addition to providing this good heat removal quality, not previously obtained with plastics, our grill provides good protection to a loudspeaker. Further, the configuration shown provides good acoustic qualities. While it is not essential, we prefer that the spacings between the U-shaped bars 27 and the T-shaped bars 15 be equal so as to provide these good acoustic qualities. The U-shaped bars 27 can also be formed individually rather than as part of the second plate 25, and these individual bars 27 fastened to the second plate 25 at the proper locations to provide the same protection for our grill. While we prefer the waterproof construction provided by a sealant in the groove 18, the sealant may be omitted and the second plate 25 placed in direct contact with the first plate 14. If desired, the second plate 25 may be welded to the first plate 14. In this case, the second plate 25 would, through metallic conduction, also act as a heat sink along with the first plate 14. And, of course, the bars 15, 27 may run in any direction relative to the radio as long as the spacings and relationships between the bars are maintained. Therefore, while our invention has been described with reference to a particular embodiment, it is to be understood that modifications may be made without departing from the spirit of the invention or from the scope of the claims.

What we claim as new and desire to secure by Letters Patent of the United States is:

1. An improved metallic, protective grill for audio loudspeakers and the like comprising:

a. a plurality of spaced, elongated, metallic bars having substantially similar cross sections, each of said cross sections being formed of a flat portion and an upright portion extending from the center thereof to form a generally T-shaped cross section;

b. said bars being positioned in substantially equally spaced relation with their elongated dimensions substantially parallel to each other and with said upright portions extending in the same direction so as to provide first elongated openings between adjacent ones of said bars;

c. a plurality of spaced, elongated, metallic elements having substantially similar cross sections, each of said cross sections being formed of a relatively thin flat portion and a relatively thin upright portion extending in the same direction from each elongated edge thereof to form a generally U-shaped cross section;

d. said elements being positioned in substantially equally spaced relation with their elongated dimensions substantially parallel to each other, and with said flat portions spaced similarly to spacings of said T-shaped cross sections so as to provide second elongated openings between adjacent ones of said flat portions;

e. and means mounting said bars and said mounted elements together so that one of said U-shaped cross-sections is positioned between but spaced from adjacent pairs of said T-shaped cross-sections, and thereby form an acoustically operable but mechanically protected grill for a loudspeaker.

2. The improved grill of claim 1 wherein said first openings are substantially similar to each other and wherein said second openings are substantially similar to each other.

3. The improved grill of claim 1 wherein said upright portions of said T-shaped cross-sections extend perpendicularly from said flat portions, and wherein said upright portions of said U-shaped cross-sections extend perpendicularly from said flat portions.

4. An improved grill construction for audio loudspeakers and the like comprising:

a. a first metallic plate having a plurality of openings therethrough, each adjacent pair of said first plate openings being separated by an elongated bar having a generally T-shaped cross-section that is similarly oriented to other T-shaped cross-sections;

b. a second metallic plate having a plurality of elongated openings therethrough, each adjacent pair of said second plate openings each separated by an elongated member having a generally U-shaped cross-section that is similarly oriented to other U-shaped cross-sections, said U-shaped cross-sections being configured to fit in a respective one of said first plate openings;

c. said first and second plates being adapted to be mounted together with said U-shaped cross-sections positioned between and spaced from adjacent pairs of said T-shaped cross-sections respectively so that the open ends of said U-shaped cross-sections are adjacent said openings in said first plate to form a protective loudspeaker grill that passes acoustic waves.

5. The improved grill construction of claim 4 wherein said first plate openings and bars extend in substantially parallel straight lines, and wherein said second plate openings and members extend in substantially parallel straight lines.

6. The improved grill construction of claim 4 wherein said first plate openings are substantially similar to each other, and wherein said second plate openings are substantially similar to each other.

7. In a radio transceiver or similar device having an acoustic loudspeaker for providing audible signals, an improved grill for protecting said loudspeaker comprising:

a. a relatively thick, flat metallic plate having a first opening through the thickness dimension of said thick plate;

b. a plurality of flat metallic bars extending across said first opening, said bars being substantially parallel and spaced first predetermined distances from each other;

c. each of said bars having a metallic reinforcing web extending perpendicularly therefrom in the same direction along at least a portion of the length of said bar;

d. a relatively thin, flat metallic plate having a second opening through the thickness dimension of said thin plate;

e. a plurality of flat metallic strips extending across said second opening, said strips being substantially parallel and having centers spaced substantially said first predetermined distances from each other;

f. each of said strips having a metallic reinforcing member extending from each of the two longer edges of said strips in the same general direction for at least a major portion of the length of said strips, said reinforcing members having a height less than the thickness of said relatively thick plate;

g. and means mounting said relatively thin plate on said relatively thick plate with said centers of said strips positioned symmetrically between a respective adjacent pair of said reinforcing webs so that said strips and said reinforcing members are spaced from said bars and said reinforcing webs to protect a loudspeaker and provide a good acoustic structure.

8. The improved grill of claim 7 wherein said relatively thin plate is mounted on said relatively thick plate with said reinforcing members extending toward said bars.

9. The improved grill of claim 8 wherein said relatively thick plate, said bars, and said reinforcing webs are integral, and wherein said relatively thin plate, said strips, and said reinforcing members are integral.

10. The improved grill of claim 9 wherein both of said plates are nonmagnetic.

* * * * *